US012247501B2

(12) United States Patent
Radulescu et al.

(10) Patent No.: US 12,247,501 B2
(45) Date of Patent: Mar. 11, 2025

(54) SWITCHING ROLLER FINGER FOLLOWER WITH INNER ARM HAVING ASYMMETRIC INNER ROLLER

(71) Applicant: Eaton Intelligent Power Limited, Dublin (IE)

(72) Inventors: Andrei Radulescu, Marshall, MI (US); Austin Zurface, Dowling, MI (US); Egidio Canzoniere, Matera (IT); Alessio Lorenzon, Avigliana (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/854,206

(22) Filed: Jun. 30, 2022

(65) Prior Publication Data

US 2022/0333508 A1 Oct. 20, 2022

Related U.S. Application Data

(63) Continuation of application No. PCT/EP2021/025021, filed on Jan. 20, 2021.

(60) Provisional application No. 62/963,236, filed on Jan. 20, 2020.

(51) Int. Cl.
*F01L 1/18* (2006.01)
*F01L 13/00* (2006.01)

(52) U.S. Cl.
CPC ..... *F01L 1/185* (2013.01); *F01L 13/0005* (2013.01); *F01L 2001/186* (2013.01); *F01L 2305/02* (2020.05)

(58) Field of Classification Search
CPC . F01L 1/185; F01L 2001/186; F01L 13/0005; F01L 13/0036; F01L 2305/02
USPC ..... 123/90.39, 90.16
See application file for complete search history.

(56) References Cited

U.S. PATENT DOCUMENTS 6,532,920 B1 * 3/2003 Sweetnam ..... F01L 13/0015 123/90.46
2008/0223324 A1 * 9/2008 Ng ..... F01L 1/185 123/90.39
2012/0266835 A1 10/2012 Harman
(Continued)

FOREIGN PATENT DOCUMENTS

CN 103492679 A 1/2014

OTHER PUBLICATIONS

International Search Report and Written Opinion for International Application No. PCT/EP2021/025021 mailed Apr. 14, 2021.

*Primary Examiner* — Kenneth J Hansen
*Assistant Examiner* — Kelsey L Stanek
(74) *Attorney, Agent, or Firm* — Meunier Carlin & Curfman LLC

(57) ABSTRACT

A switching roller finger follower (SRFF) assembly for valve actuation comprises an outer arm, an inner arm, an inner roller, a bearing axle and a pair of outer rollers. The outer arm is pivotally coupled to a pivot axle. The inner arm is at least partially disposed within the outer arm and pivotally coupled to the pivot axle. The inner roller assembly comprise a bushing and an outer ring. The bushing defines a curved slot therein. The bushing is fixed to the inner arm. The outer ring is configured to rotate around the bushing. The bearing axle extends through the curved slot. The pair of outer rollers are disposed on each end of the bearing axle.

17 Claims, 7 Drawing Sheets

(56) References Cited

U.S. PATENT DOCUMENTS

2019/0301315 A1 10/2019 Stretch

* cited by examiner

SWITCHING ROLLER FINGER FOLLOWER WITH INNER ARM HAVING ASYMMETRIC INNER ROLLER

CROSS-REFERENCE TO RELATED APPLICATIONS

This application is a continuation of International Application No. PCT/EP2021/025021 filed Jan. 20, 2021, which claims the benefit of U.S. Provisional Patent Application Ser. No. 62/963,236 filed Jan. 20, 2020, the contents of which are incorporated herein by reference thereto.

FIELD

This application relates to switching roller finger followers and more specifically to a switching roller finger follower having an inner arm with an asymmetric inner roller for improved stiffness.

BACKGROUND

Switching rocker arms have been used to alter the operation and performance of internal combustion engines. For example, specialized rocker arms may be used to provide variable valve actuation (WA) such as variable valve lift (WL) system and cylinder deactivation (CDA), such as that described in commonly owned U.S. Pat. No. 8,215,275 and U.S. application Ser. No. 16/340,165, hereby incorporated by reference in their entirety. Such mechanisms are developed to improve performance, fuel economy, and/or reduce emissions of the engine. Several types of the WA rocker arm assemblies include an inner rocker arm within an outer rocker arm that are biased together with torsion springs.

Switching rocker arms allow for control of valve actuation by alternating between latched and unlatched states. A latch, when in a latched position causes both the inner and outer rocker arms to move as a single unit. When unlatched, the rocker arms are allowed to move independent of each other. In some circumstances, these arms can engage different cam lobes, such as low-lift lobes, high-lift lobes, and no-lift lobes. Mechanisms are required for switching rocker arm modes in a manner suited for operation of internal combustion engines.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A switching roller finger follower (SRFF) assembly for valve actuation comprises an outer arm, an inner arm, an inner roller, a bearing axle and a pair of outer rollers. The outer arm is pivotally coupled to a pivot axle. The inner arm is at least partially disposed within the outer arm and pivotally coupled to the pivot axle. The inner roller assembly comprise a bushing and an outer ring. The bushing defines a curved slot therein. The bushing is fixed to the inner arm. The outer ring is configured to rotate around the bushing. The bearing axle extends through the curved slot. The pair of outer rollers are disposed on each end of the bearing axle.

In additional features, the bushing is fixed to the inner arm at an interface surface defined between an outer diameter of the bushing and an inner diameter of the inner arm. The bushing is one of welded, staked, glued, mechanically fixed and chemically fixed to the inner arm at the interface surface. The bushing is fixed to the inner arm in predefined orientation relative to a pivot axle and a latch pin. The bushing can be keyed to the inner arm whereby rotation of the bushing at the interface surface is precluded. The bushing can define a planar portion on the outer diameter and the inner arm defines a flat portion on the inner diameter.

In other features, the curved slot is defined by opposed walls that are curved in the same direction. The curved slot can be further defined by an end wall having a linear profile. In other features, the curved slot can be defined by opposed walls curved inwardly toward each other. The SRFF assembly can further define a latch assembly that is configured to selectively latch the inner arm to the outer arm to prevent relative movement therebetween.

A switching roller finger follower (SRFF) assembly constructed in accordance to another example of the present disclosure for valve actuation comprises an outer arm, an inner arm, an inner roller, a bearing axle and a pair of outer rollers. The outer arm is pivotally coupled to a pivot axle. The inner arm is at least partially disposed within the outer arm and pivotally coupled to the pivot axle. The inner roller assembly comprise a bushing and an outer ring. The bushing is fixed to the inner arm and defines a bearing axle passage having a non-circular profile. The outer ring is configured to rotate around the bushing. The bearing axle extends through the curved slot. The pair of outer rollers are disposed on each end of the bearing axle.

In other features, the bushing is fixed to the inner arm at an interface surface defined between an outer diameter of the bushing and an inner diameter of the inner arm. The bushing can be one of welded, staked, glued, mechanically fixed and chemically fixed to the inner arm at the inner surface. In one configuration, the bushing is D-shaped. The bushing can be keyed to the inner arm whereby rotation of the bushing at the interface surface is precluded. The bushing can define a planar portion on the outer diameter. The inner arm can define a flat portion on the inner diameter. The curved slot can be defined by opposed walls curved in the same direction. In another configuration, the curved slot is further defined by an end wall having a linear profile.

A method of assembling a switching roller finger follower (SRFF) assembly for valve actuation is provided. An inner arm is positioned on a fixture. The inner arm has an inner roller assembly including an outer roller and an inner bushing. The inner arm is loaded with a pivot axle and a latch pin thereby creating a bearing axle load on the inner bushing. The inner bushing is fixed to the inner arm subsequent to the loading.

In other features, fixing includes fixing the inner arm at an interface surface defined between an outer diameter of the bushing and an inner diameter of the inner arm. The bushing is fixed to the inner arm by one of welding, staking, gluing, mechanical fixing and chemical fixing at the interface surface.

DETAILED DESCRIPTION

Figure 1A:
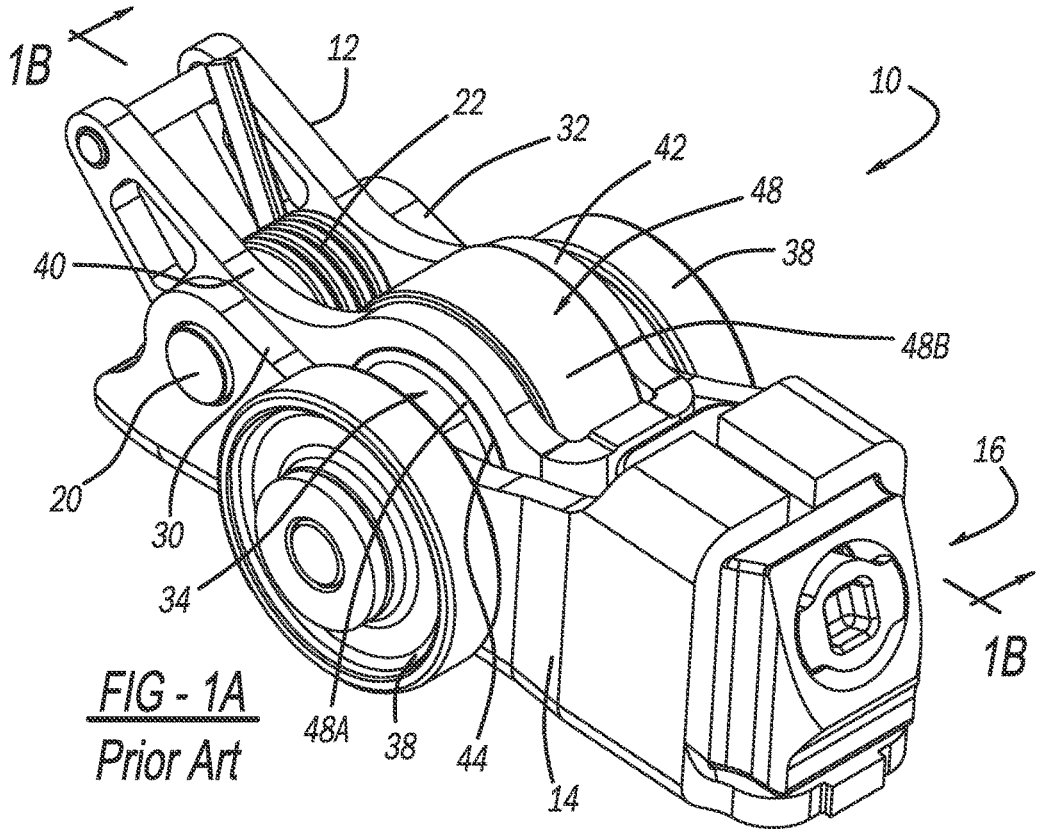
FIG - 1A Prior Art
FIG. 1A is a perspective view of a switching roller finger follower (SRFF) according to one prior art example.

Described herein are switching roller finger follower (SRFF) assemblies that include a specialized inner roller that incorporates a bushing to improve stiffness of the SRFF. A related manufacturing process is also disclosed to improve stiffness of the SRFF by increasing the bending moment of inertia and reducing deflection. More specifically, the SRFF assembly improves stiffness by increasing the moment of inertia in the vertical direction to reduce bending deflection, and by reducing the inner arm deflection by welding the inner roller to the inner body.

With initial reference to FIGS. 1A-10, a switching roller finger follower (SRFF) assembly constructed in accordance to one prior art example is shown and generally identified at reference numeral 10. In the example embodiment, the SRFF assembly 10 generally includes an inner arm 12 and an outer arm 14. The default configuration is in the normal-lift (latched) position where the inner arm 12 and the outer arm 14 are locked together, causing an engine valve (not shown) to open and allowing the cylinder to operate as it would in a standard valvetrain. When a latch assembly 16 is engaged (e.g., oil from an oil control valve feeds a hydraulic lash adjuster 18 (FIG. 10) to engage latch assembly 16), the inner arm 12 and the outer arm 14 operate together like a standard rocker arm to open an engine valve 19. In the no-lift (unlatched) position, the inner arm 12 and the outer arm 14 can move independently to enable cylinder deactivation.

In the example embodiment, the inner arm 12 and the outer arm 14 are both mounted to a pivot axle 20, which secures the inner arm 12 to the outer arm 14 while also allowing a rotational degree of freedom pivoting about the pivot axle 20 when the SRFF assembly 10 is in a deactivated state. A lost motion torsion spring 22 is secured to the pivot axle 20 and is configured to bias the position of the inner arm 12 so that it always maintains continuous contact with a camshaft lobe (not shown).

As shown in FIG. 1A, the outer arm 14 includes a first outer side arm 30 and a second outer side arm 32. The first and second outer side arms 30, 32 each define an aperture 34 configured to receive a bearing axle 36 therethrough. An outer roller 38 is mounted on each end of the bearing axle 36 outboard of the first and second outer side arms 30, 32.

Figure 1B:
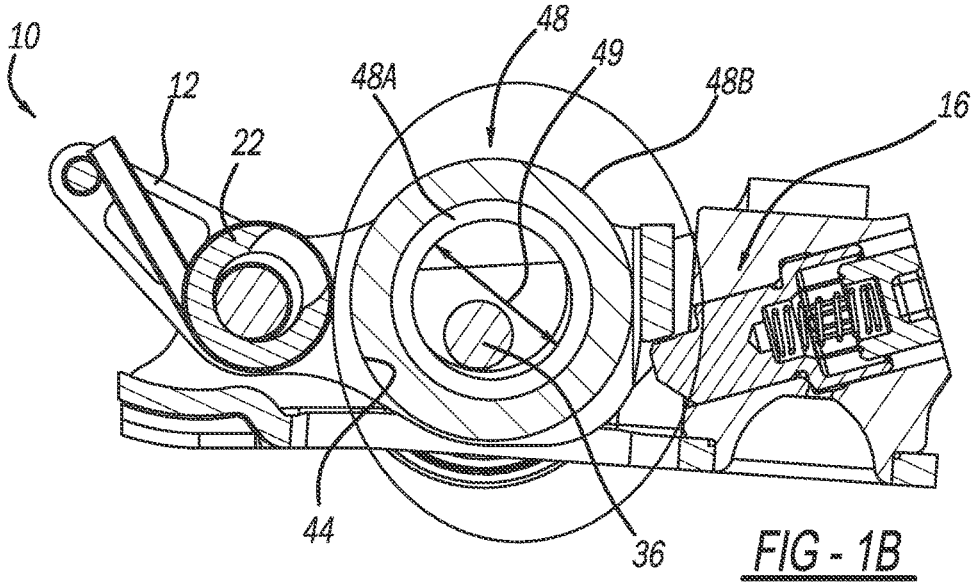
FIG - 1B Prior Art
FIG. 1B is a sectional view taken through lines 1B-1B of the SRFF of FIG. 1A.
Figure 1C:
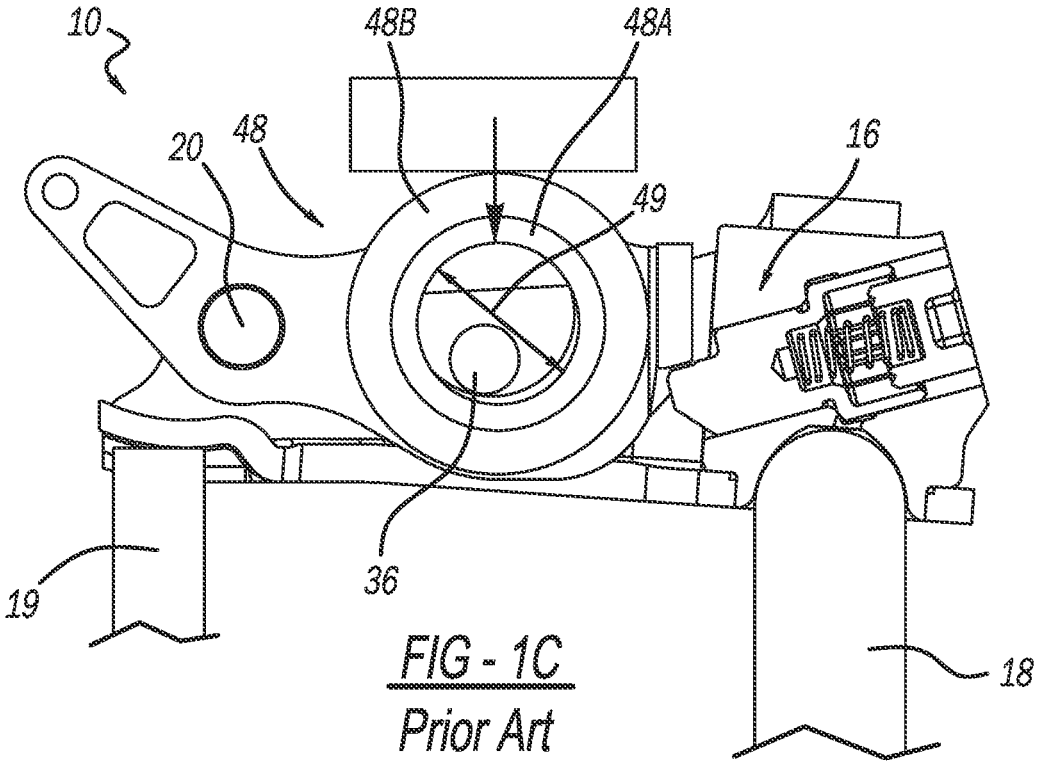
FIG - 1C Prior Art
FIG. 1C is a force diagram illustrating a load applied to the outer and inner rollers of the SRFF of FIG. 1A.

As shown in FIGS. 1A and 1B, the inner arm 12 is disposed between the first outer side arm 30 and the second outer side arm 32. The inner arm 12 includes a first inner side arm 40 and a second inner side arm 42. The first and second inner side arms 40, 42 each include an aperture 44 configured to receive the bearing axle 36 therethrough. An inner roller assembly 48 includes an inner ring 48A and an outer ring 48B. As will become appreciated by the following discussion, the inner ring 48A provides low stiffness to the inner roller assembly 48. In particular, the inner ring 48A defines a generally large inner diameter 49 contributing to reduced mass of the inner ring 48A as a whole.

Figure 2A:
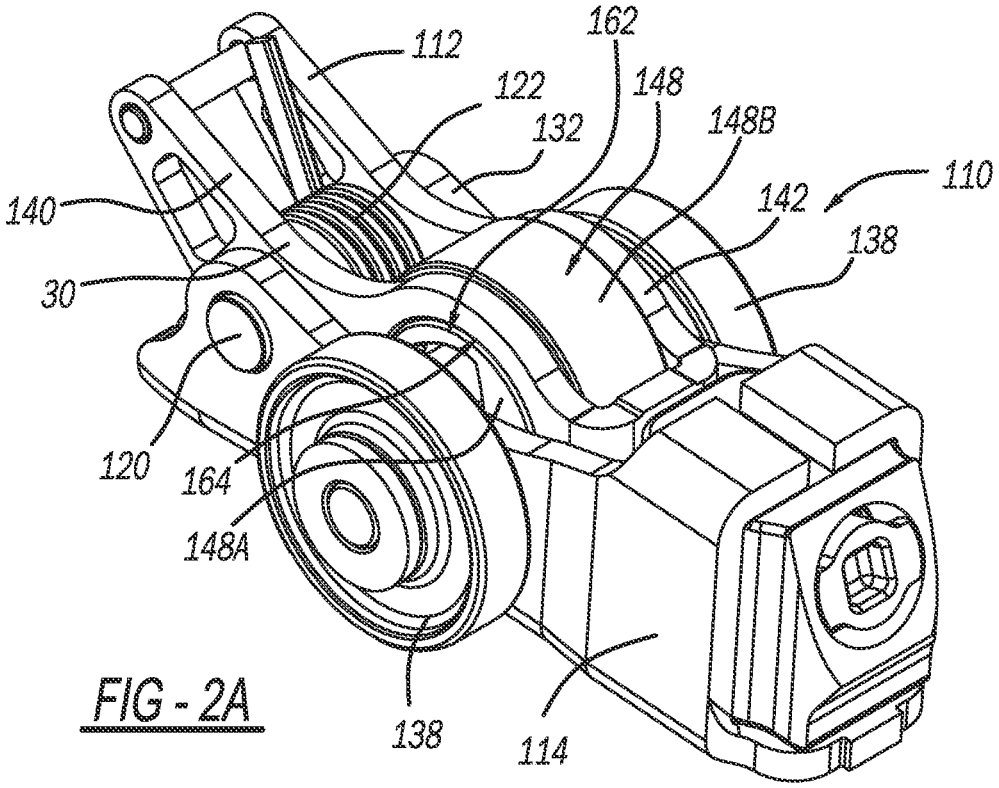
FIG. 2A is a perspective view of an SRFF that incorporates a bushing according to one example of the present disclosure.
Figure 2B:
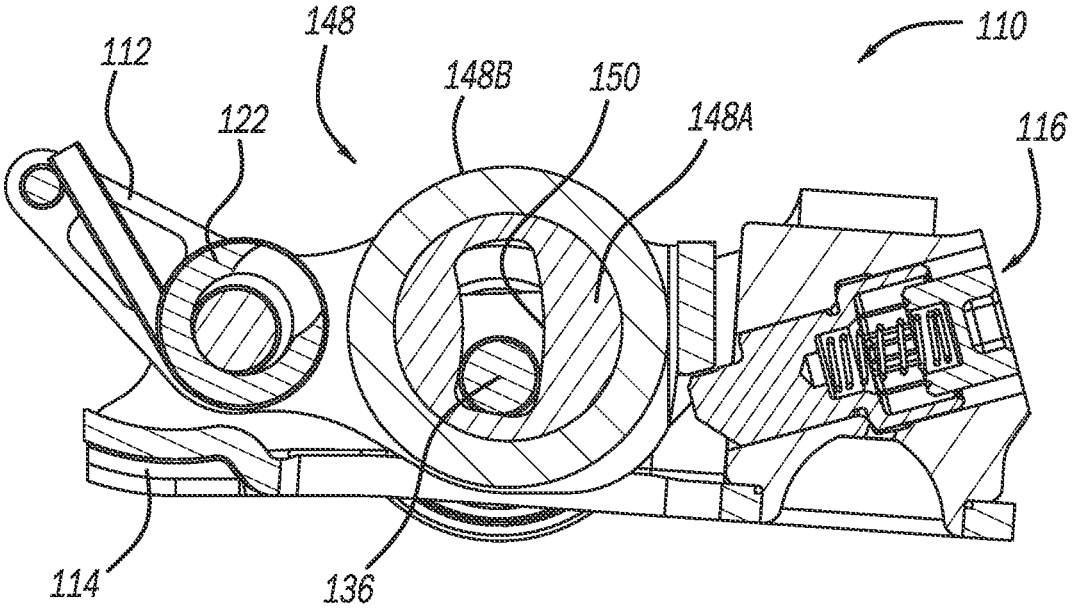
FIG. 2B is a sectional view taken through lines 2B-2B of the SRFF of FIG. 2A.
Figure 2C:
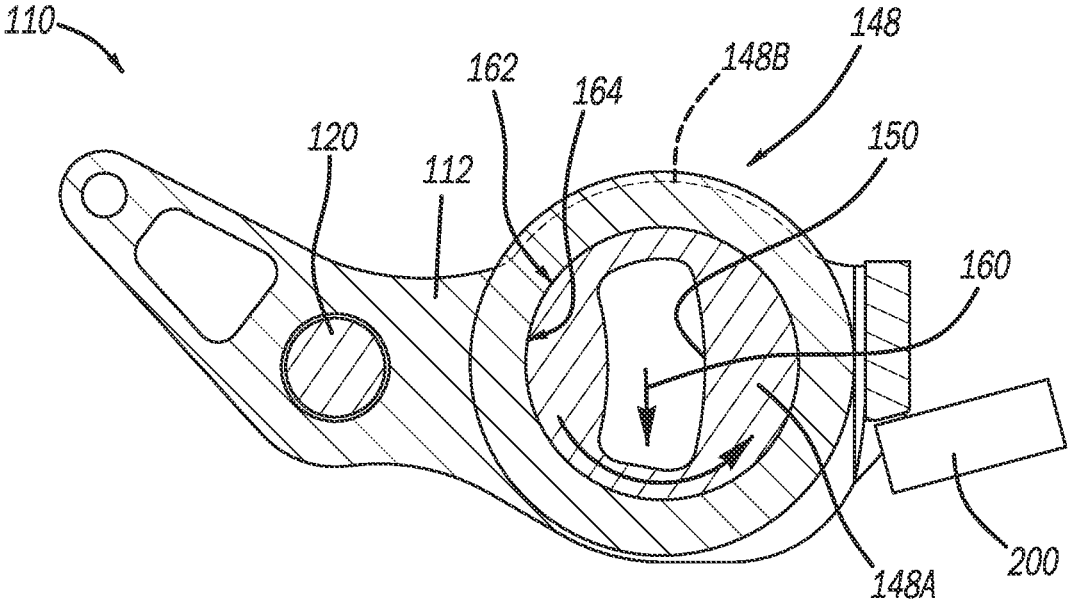
FIG. 2C is a side view of the inner arm of the SRFF of FIG. 2A showing an exemplary assembly step according to the present disclosure.

With reference to FIGS. 2A-2C, a switching roller finger follower (SRFF) assembly constructed in accordance to one example of the present disclosure is shown and generally identified at reference numeral 110. Unless otherwise described herein, the SRFF assembly 110 is constructed similarly to the SRFF 10 described above. In this regard, like reference numerals have been used having a 100 suffix. In the example embodiment, the SRFF assembly 110 generally includes an inner arm 112 and an outer arm 14. The default configuration is in the normal-lift (latched) position where the inner arm 112 and the outer arm 114 are locked together, causing an engine valve (not shown) to open and allowing the cylinder to operate as it would in a standard valvetrain. When a latch assembly 116 is engaged (e.g., oil from an oil control valve feeds a hydraulic lash adjuster 118 (FIG. 2C) to engage latch assembly 116), the inner arm 112 and the outer arm 114 operate together like a standard rocker arm to open an engine valve. In the no-lift (unlatched) position, the inner arm 112 and the outer arm 114 can move independently to enable cylinder deactivation.

In the example embodiment, the inner arm 112 and the outer arm 114 are both mounted to a pivot axle 120, which secures the inner arm 112 to the outer arm 114 while also allowing a rotational degree of freedom pivoting about the pivot axle 120 when the SRFF assembly 110 is in a deactivated state. A lost motion torsion spring 122 is secured to the pivot axle 120 and is configured to bias the position of the inner arm 112 so that it always maintains continuous contact with a camshaft lobe (not shown).

As shown in FIG. 2A, the outer arm 114 includes a first outer side arm 130 and a second outer side arm 132. The first and second outer side arms 130, 132 each define an aperture 134 configured to receive a bearing axle 136 therethrough. An outer roller 138 is mounted on each end of the bearing axle 136 outboard of the first and second outer side arms 130, 132.

As shown in FIGS. 2A and 2B, the inner arm 112 is disposed between the first outer side arm 130 and the second outer side arm 132. The inner arm 112 includes a first inner side arm 140 and a second inner side arm 142. The first and second inner side arms 140, 142 each include an aperture 144 configured to receive the bearing axle 136 therethrough. An inner roller assembly 148 includes an inner ring or bushing 148A and an outer ring 148B. The bushing 148A is coupled (e.g., welded, stake, chemical bond, etc.) to the inner arm 112 between the first and second inner side arms 140, 142. The outer ring 148B is permitted to rotate around the bushing 148A.

Figure 3A:
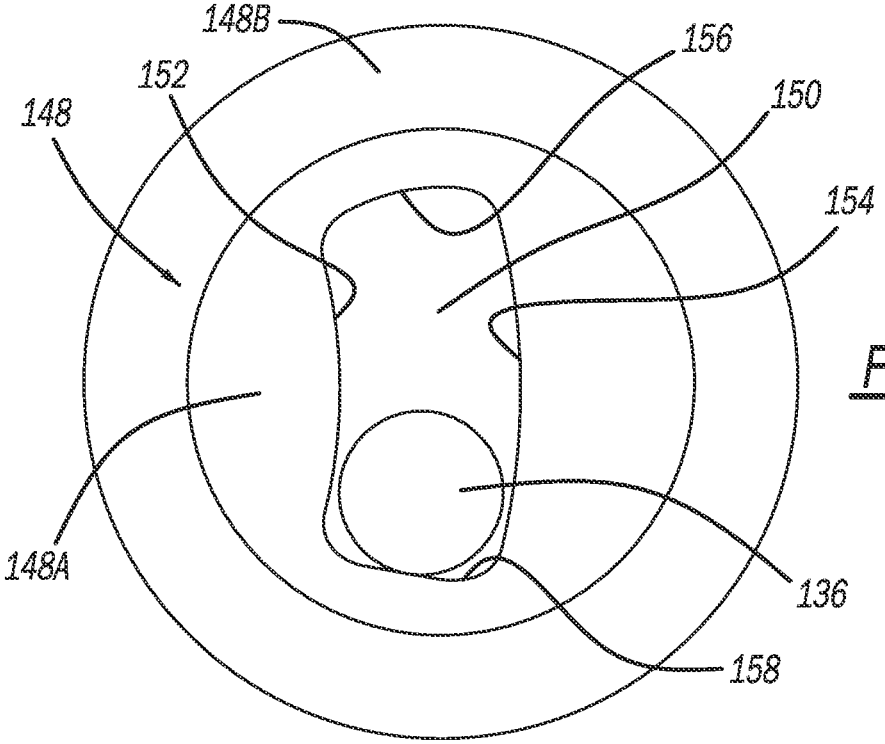
FIG. 3A is a side view of the bushing used in the SRFF of FIG. 2A and shown with the inner roller and bearing axle.
Figure 3B:
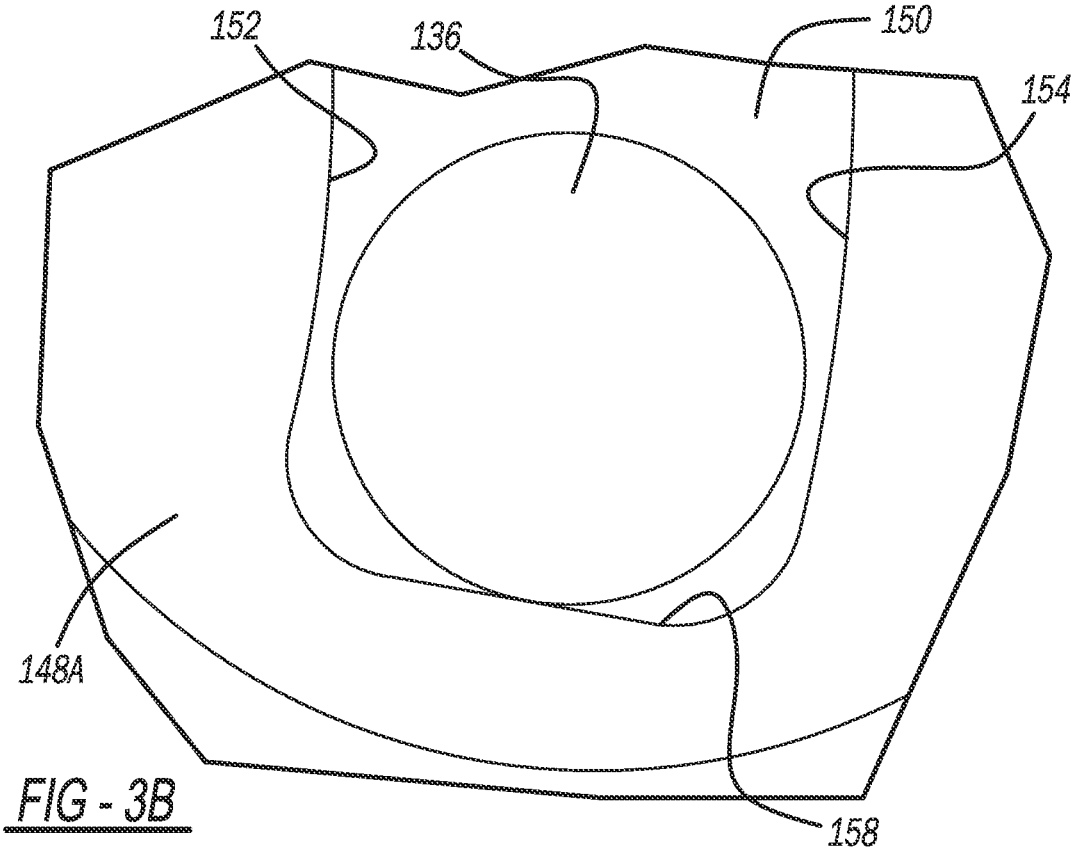
FIG. 3B is a detail view of the bushing and bearing axle shown in FIG. 3A.

With further reference now to FIGS. 3A and 3B, additional features of the inner roller assembly 148 will be described. The bushing 148A includes a slotted aperture 150, as described herein in more detail. The aperture 150 can provide a bearing axle passage having a non-circular profile. Notably, the non-circular profile of the aperture 150 is distinct from the circular profile provided by the inner ring 48A in the Prior Art example (FIG. 1B). The bushing 148A is designed with slot 150 to provide clearance for the bearing axle 136. Because the passage for the bearing axle 136 is limited to a slot, rather than a large opening spanning an entire radius 49 (FIG. 1AB), increased material can be used for the bushing 148A offering many advantages as explained herein. In the example embodiment, the slot 150 is curved such that opposed sidewalls 152, 154 are curved (e.g., radius of curvature) with end walls 156, 158 extending in a generally radial direction between the end walls 156, 158. The inner roller assembly 148 is configured to increase the moment of inertia by, for example, approximately 50% (based on CREO® MOI in a vertical direction). Coupling the bushing 148A of the inner roller assembly 148 to the inner arm 112 is configured to reduce deflection experienced at the inner arm 112. As such, in the example embodiment, the shape of the curved slot 150 is critical to reduce variability at the inner arms shelf due to manufacturing variation (pivot center to inner roller center).

With particular reference to FIG. 2C, one example of assembling the SRFF 110 according to the present disclosure will be described. The inner arm 112 is positioned on a fixture and loaded with the pivot axle 120 and the latch pin 200. A load 160 is created with respect to the bearing axle 136. In this position, the bushing 148A is fixed to the inner arm 112. The bushing 148A can be welded, staked, glued, mechanically fixed, chemically fixed or otherwise fixed to the inner arm 112. It will be appreciated that the fixing is occurring at an interface surface between an outer diameter 162 of the bushing 148A and an inner diameter 164 defined by the inner arm 112. Again, the present configuration provides a fixed inner ring (bushing) 148A relative to the inner arm 112 whereas the prior art configuration shown in FIGS. 1A-10 provides a rotating inner ring (unfixed) 48A.

Because the bushing 148A is fixed to the inner arm 112, the stiffness of the inner arm 112 and to the overall SRFF assembly 110 is increased. In this regard, when the inner arm 112 is loaded, the improved stiffness will inhibit the tendency of the first and second inner side arms 140, 142 (and the bushing 148A) to open up (deflect).

As shown in FIG. 3A, the geometry of the end wall 158 of the slot 150 is optimized to reduce variability of the latch shelf (latch lash) after the inner arm 12 is assembled with the rest of the SRFF assembly components. The end wall 158 can have a linear or planar profile. In one example, the slot 150 is designed to allow for +1-1.0 mm variability of the bearing hole 34 location inside the outer arm 14.

Figure 4A:
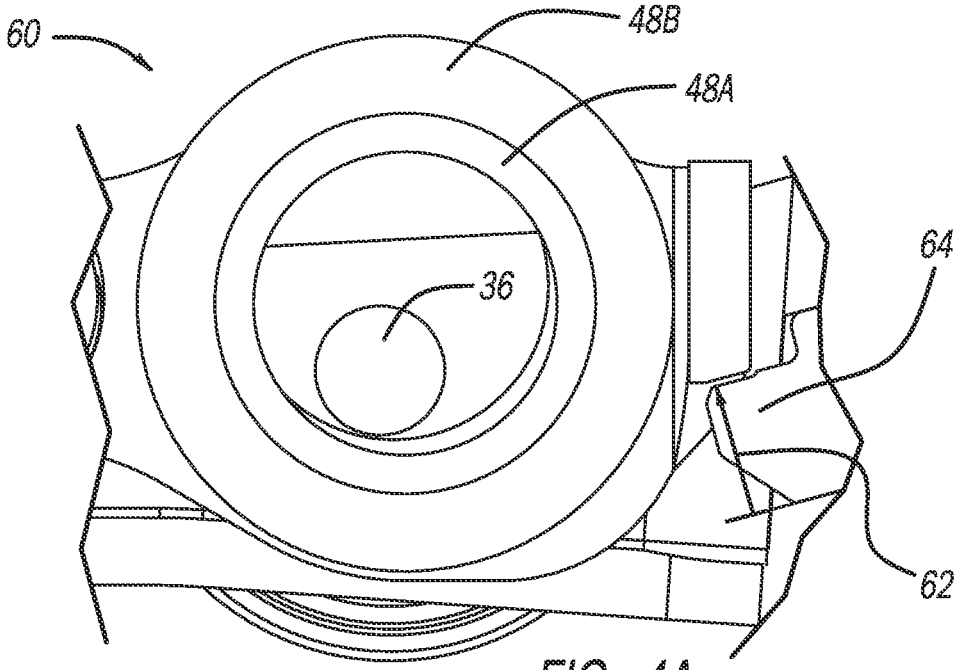
FIG - 4A Prior Art
FIG. 4A is a detail view of the inner roller and bearing axle incorporated in the Prior Art SRFF of FIGS. 1A and 2A.
Figure 4B:
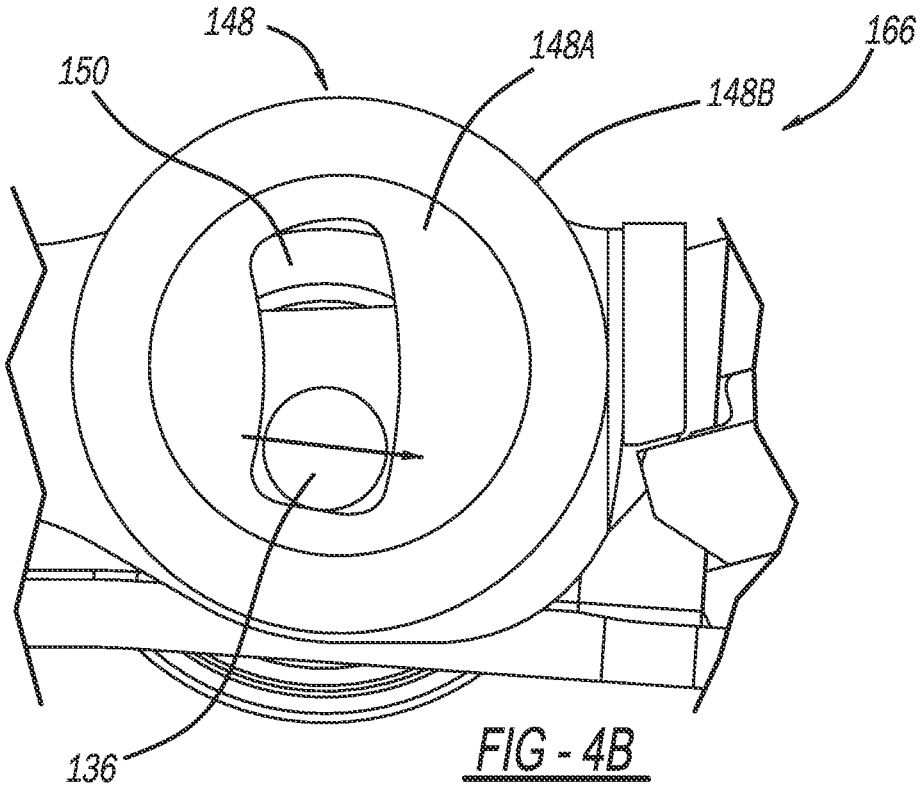
FIG. 4B is a detail view of the inner roller, bushing and bearing axle incorporated in the SRFF of FIGS. 2A and 2B.

FIG. 4A illustrates a baseline design 60 showing a shelf height 62 of a latch 64 of a latch assembly for the Prior Art arrangement shown in FIGS. 1A-10. FIGS. 4B-4D illustrate various additional embodiments of inner roller 148A. A first embodiment 166 is shown in FIG. 4B that corresponds to the inner roller assembly 148 described above in FIGS. 2A and 2B. The embodiment 166 is configured to improve moment of inertia (e.g., 50% from baseline), but may require orientation during assembly. The bottom of the slot is configured to limit the inner arm shelf height variation from bearing axle positional tolerance potentially minimizing the latch pin categories.

Figure 4C:
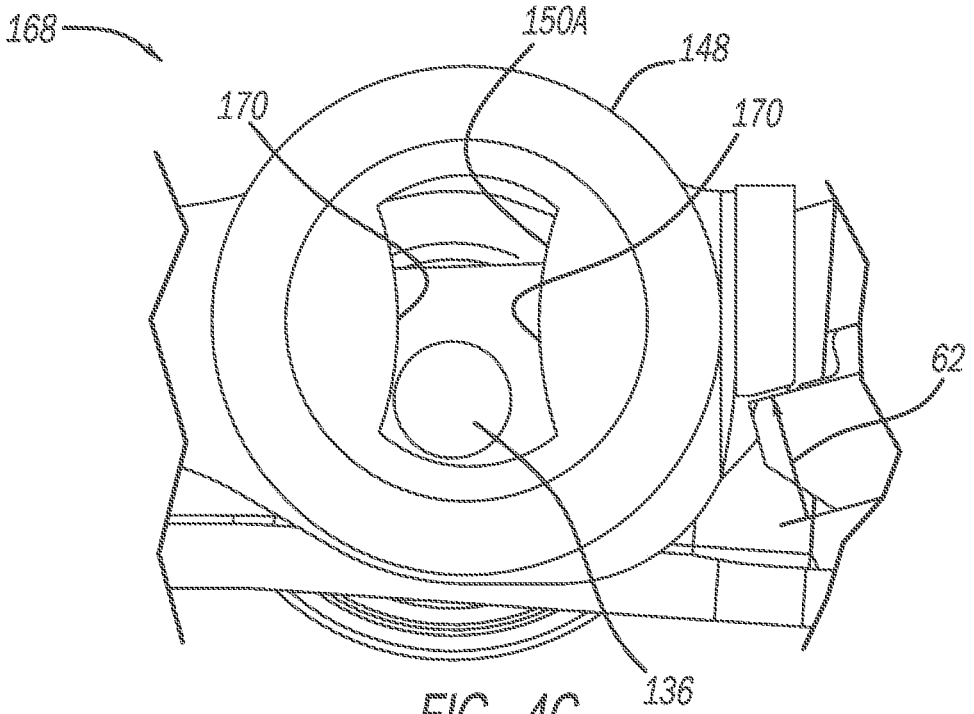
FIG. 4C is a detail view of an inner roller, bushing and bearing axle incorporated in an SRFF constructed in accordance to additional features of the present disclosure.
Figure 4D:
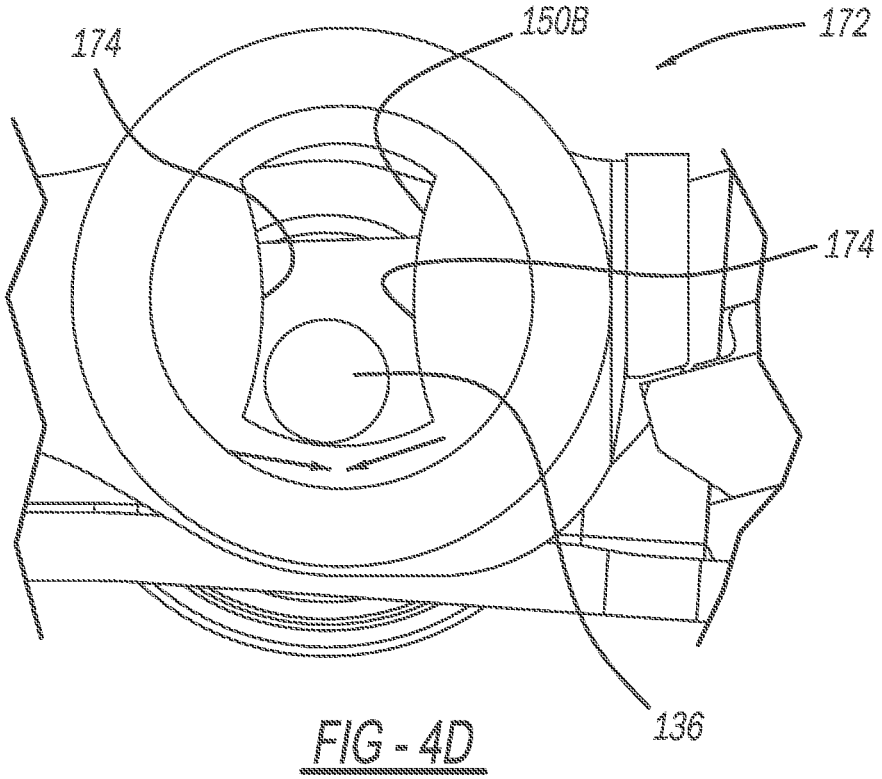
FIG. 4D is a detail view of an inner roller, bushing and bearing axle incorporated in an SRFF constructed in accordance to additional features of the present disclosure.

A second embodiment 168 is shown in FIG. 4C. The second embodiment 168 illustrates slot 150A with opposed inwardly curved walls 170, which is configured to improve moment of inertia (e.g., 40% from baseline). However, such a design may not require orientation during assembly. Bearing axle positional tolerance variation may affect the inner arm shelf height variation. A third embodiment 172 illustrates slot 150B with opposed inwardly curved walls 174, which is configured to improve moment of inertia (e.g., 35%). However, such a design may not require orientation during assembly. Bearing axle positional tolerance variation may affect the inner arm shelf height variation.

Figure 5A:
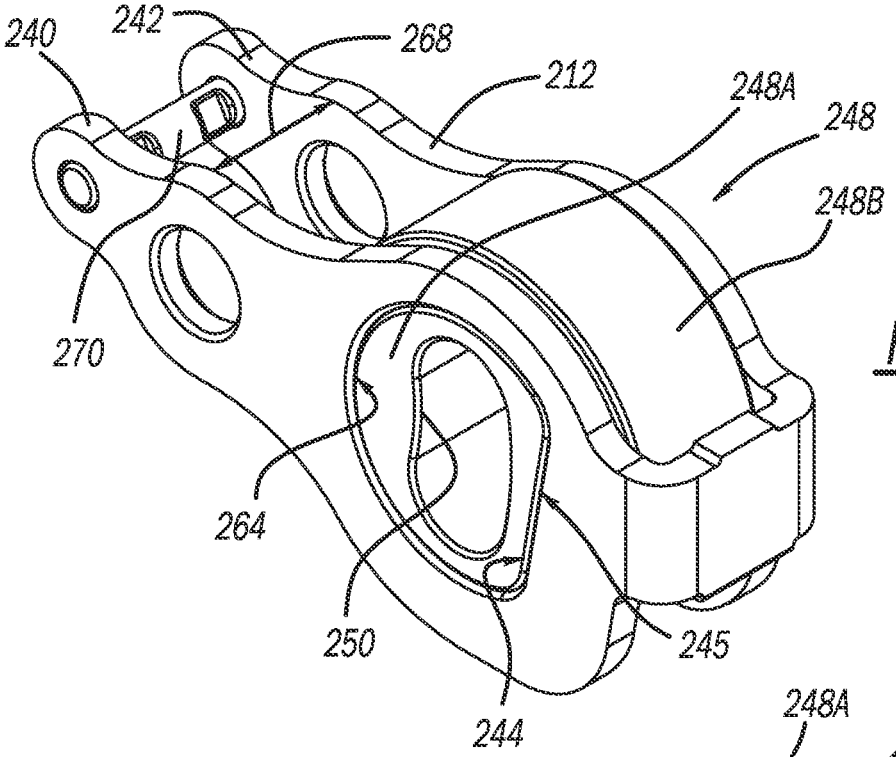
FIG. 5A is a perspective view of a partial SRFF having an inner arm and bushing constructed in accordance to additional features of the present disclosure.
Figure 5B:
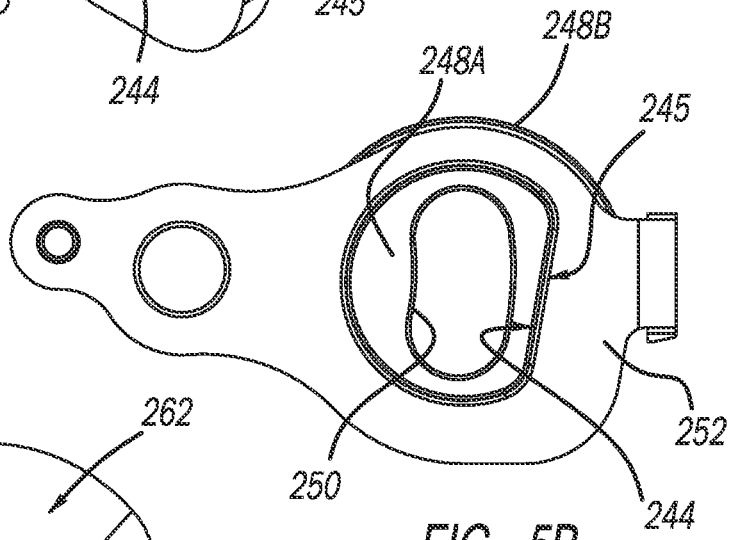
FIG. 5B is a side view of the partial SRFF of FIG. 5A.
Figure 5C:
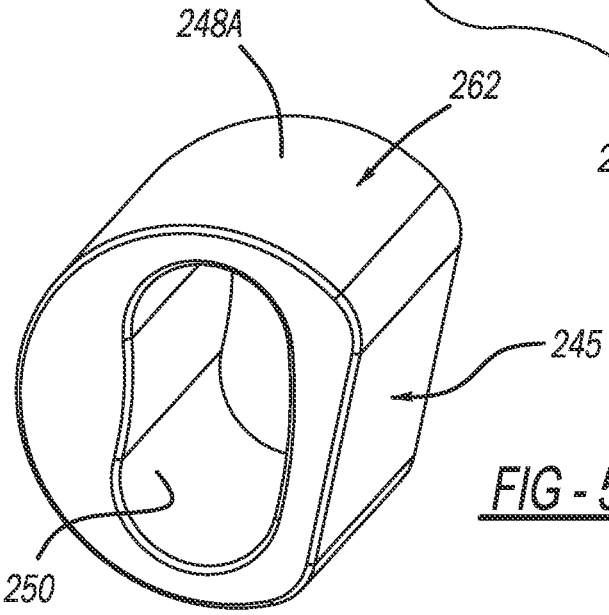
FIG. 5C is a perspective view of the bushing of FIG. 5A.

With reference now to FIGS. 5A-5C, an inner roller assembly 248 constructed in accordance to another example of the present teachings will be described. Unless otherwise described herein, the inner roller assembly 248 is constructed similarly to the inner roller assembly 148 described above. The inner roller assembly 248 includes an inner ring or bushing 248A and an outer ring 248B. The inner ring or bushing 248A is fixed to the inner arm 212 using any of the methods described above. The bushing 248A defines an outer diameter 262 having a planar portion or flat 245. The inner arm 212 includes an inner diameter 264 defined collectively by the first inner side arm 240 and second inner side arm 242. The inner arm 212 further defines a collective flat portion 244 on the first inner side arm 240 and the second inner side arm 242. The planar portion 245 of the bushing 248A and the flat portion 244 of the inner arm 212 allows the bushing 248A to key to the inner arm 212. In this regard, the geometries cooperate to inhibit rotation of the bushing 248A within the inner dimeter 264 of the inner arm 212. It will be appreciated that while the keying feature described herein is in the form of flats, other geometries that offer a non-circular interface between the bushing 248A and inner arm 212 are within the scope of the present disclosure.

Additional material can be provided on the inner arm 212 at area 252 due to the D-shaped profile of the bushing 248A. The bend shape is improved from a manufacturing standpoint. Moreover, an internal width or distance 268 between the first and second inner side arms 240 and 242 can be increased while reducing the thickness of the sheet metal used to create the inner arm 212. This relationship allows an increase in width of the outer ring 248B and an improvement in the design of a torsion spring (see 22, FIG. 1A). Having lower stress realized in the bending area near the cross-pin 270 while at the same time providing a solid bushing 248A, the thickness required for formation of the inner arm 212 can be reduced. Assembly packaging can therefore be improved.

While the present disclosure illustrates various embodiments, and while these embodiments have been described in some detail, it is not the intention of the applicant to restrict or in any way limit the scope of the claimed invention to such detail. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's claimed invention. Moreover, the foregoing embodiments are illustrative, and no single feature or element is essential to all possible combinations that may be claimed in this or a later application.

What is claimed is:

1. A switching roller finger follower (SRFF) assembly for valve actuation, the (SRFF) assembly comprising:

an outer arm pivotally coupled to a pivot axle;

an inner arm at least partially disposed within the outer arm and pivotally coupled to the pivot axle;

an inner roller assembly comprising:

a bushing having opposed walls configured to define a curved slot therein, wherein the opposed walls are curved inwardly toward each other, the bushing fixed to the inner arm; and an outer ring configured to rotate around the bushing;

a bearing axle extending through the curved slot; and a pair of outer rollers disposed on each end of the bearing axle.

2. The SRFF assembly of claim 1 wherein the bushing is fixed to the inner arm at an interface surface defined between an outer diameter of the bushing and an inner diameter of the inner arm.

3. The SRFF assembly of claim 2 wherein the bushing is one of welded, staked, glued, mechanically fixed and chemically fixed to the inner arm at the interface surface.

4. The SRFF assembly of claim 3, wherein the bushing is fixed to the inner arm in a predefined orientation relative to a pivot axle and a latch pin.

5. The SRFF assembly of claim 2 wherein the bushing is keyed to the inner arm whereby rotation of the bushing at the interface surface is precluded.

6. The SRFF assembly of claim 5 wherein the bushing defines a planar portion on the outer diameter and the inner arm defines a flat portion on the inner diameter.

7. The SRFF assembly of claim 1, wherein the curved slot is further defined by an end wall having a linear profile.

8. The SRFF assembly of claim 1, further comprising a latch assembly configured to selectively latch the inner arm to the outer arm to prevent relative movement therebetween.

9. A switching roller finger follower (SRFF) assembly for valve actuation, the (SRFF) assembly comprising:

an outer arm pivotally coupled to a pivot axle;

an inner arm at least partially disposed within the outer arm and pivotally coupled to the pivot axle;

an inner roller assembly comprising:

a bushing fixed to the inner arm and defining a bearing axle passage having a non-circular profile, wherein the non-circular profile is defined by opposed walls curved inwardly toward each other; and an outer ring configured to rotate around the bushing;

a bearing axle extending through the bearing axle passage; and a pair of outer rollers disposed on each end of the bearing axle.

10. The SRFF assembly of claim 9, wherein the non-circular profile is further defined by an end wall having a linear profile.

11. The SRFF assembly of claim 9 wherein the bushing is fixed to the inner arm at an interface surface defined between an outer diameter of the bushing and an inner diameter of the inner arm.

12. The SRFF assembly of claim 11 wherein the bushing is one of welded, staked, glued, mechanically fixed and chemically fixed to the inner arm at the interface surface.

13. The SRFF of claim 12 wherein the bushing is D-shaped.

14. The SRFF assembly of claim 11 wherein the bushing is keyed to the inner arm whereby rotation of the bushing at the interface surface is precluded.

15. The SRFF assembly of claim 14 wherein the bushing defines a planar portion on the outer diameter and the inner arm defines a flat portion on the inner diameter.

16. A method of assembling a switching roller finger follower (SRFF) assembly for valve actuation, the method comprising:

positioning an inner arm on a fixture, positioning an inner roller assembly including an outer roller and an inner bushing in the inner arm;

loading the inner arm with a pivot axle and a latch pin thereby creating a bearing axle load on the inner bushing; and fixing the inner bushing to the inner arm subsequent to the loading.

17. The method of claim 16 wherein the fixing comprises:

fixing the inner bushing to the inner arm at an interface surface defined between an outer diameter of the bushing and an inner diameter of the inner arm; and one of welding, staking, gluing, mechanical fixing and chemical fixing the inner bushing to the inner arm at the interface surface.

* * * * *